US005516141A

United States Patent [19]

Stritzl et al.

[11] Patent Number: 5,516,141

[45] Date of Patent: May 14, 1996

[54] SKI BRAKE

[75] Inventors: Karl Stritzl, Vienna; Hubert Wuerthner, Hainburg/Donau; Helmut Wladar, Vienna, all of Austria

[73] Assignee: HTM Sport-und Freizeitgeraete Aktiengesellschaft, Schwechat, Austria

[21] Appl. No.: 353,468

[22] Filed: Dec. 9, 1994

[30] Foreign Application Priority Data

Dec. 10, 1993 [AT] Austria ..... 2500/93

[51] Int. Cl.[6] ..... A63C 7/10

[52] U.S. Cl. ..... 280/605; 188/6

[58] Field of Search ..... 280/605, 604; 188/6, 8

[56] References Cited

U.S. PATENT DOCUMENTS

| | | | |
|---|---|---|---|
| 4,108,466 | 8/1978 | Weigl et al. | 280/605 |
| 4,266,802 | 5/1981 | Svoboda | 280/605 |
| 4,463,967 | 8/1984 | Klubitschko | 280/605 |
| 5,150,912 | 9/1992 | Lucas et al. | 280/605 |

FOREIGN PATENT DOCUMENTS

| | | | |
|---|---|---|---|
| 355969 | 4/1980 | Austria . | |
| 364727 | 11/1981 | Austria . | |
| 389819 | 7/1989 | Austria . | |
| 2330419 | 8/1977 | France . | |
| 2586578 | 3/1987 | France | 280/605 |
| 2341658 | 3/1974 | Germany . | |
| 2462391 | 12/1976 | Germany . | |
| 3106688 | 9/1982 | Germany | 280/605 |
| 3110743 | 10/1982 | Germany . | |
| 3145646 | 5/1983 | Germany . | |

*Primary Examiner*—Matthew C. Graham
*Attorney, Agent, or Firm*—Flynn, Thiel, Boutell & Tanis

[57] ABSTRACT

A ski brake, which can assume a skiing position and a braking position, having a base plate adapted to be fastened on a ski or a ski binding, and on which breaking levers, each having a braking arm and an operating arm, are arranged symmetrically with respect to a central longitudinal plane are pivotal about an axis extending essentially transversely with respect to the ski. A stepping plate is connected to the base plate through a connecting piece and is loaded upwardly by at least one operating spring. The operating spring is supported in the base plate and engages through at least one extension arm spaced from the connecting piece the underside of the stepping plate, with the point of engagement of the spring on the stepping plate being variable in longitudinal direction during a pivoting movement of the braking levers.

14 Claims, 7 Drawing Sheets

SKI BRAKE

FIELD OF THE INVENTION

The invention relates to a ski brake, which can assume a skiing position and a braking position, having a base plate adapted to be fastened on a ski or a ski binding, and on which braking levers, each having a braking arm and an operating arm, are arranged symmetrically with respect to a central longitudinal and are pivotal about an axis extending essentially transversely with respect to the ski. A stepping plate loaded essentially upwardly by at least one operating spring is connected to the base plate through a pivotal connecting piece, and on which stepping plate the operating arms of the braking levers are supported, with the braking arms of the braking levers being pivotal in the skiing position as compared with the position in the braking position toward the longitudinal axis of the ski.

BACKGROUND OF THE INVENTION

Ski brakes of the above-mentioned type are known. For example, DE-OS 3 145 646 (Marker) describes a ski brake in which an essentially U-shaped braking lever is provided, which together with a pedal (stepping plate) and a connecting piece, on which a spring engages, forms a lever system which upon pivoting of the braking lever out of the braking position into the skiing position is pressured down against the force of the spring. In order to permit a complete pressing down, the braking lever is supported longitudinally movably on the stepping plate. Furthermore, essentially vertical guide surfaces, which are inclined below the stepping plate with respect to the central longitudinal plane, are provided to keep the braking levers pressed in direction of the center of the ski in the skiing position.

A ski brake has furthermore become known from DE-PS 3 110 743 (Marker), which in contrast to the above-described brake (DE-OS 3 145 646), not the braking lever but the connecting piece is supported movably in longitudinal direction on the stepping plate in order to enable a complete pressing down of the lever system.

A disadvantage of the two above-described ski brakes is among others that the spring engages very low at the connecting piece so that a relatively strong spring force is needed in order to produce the desired initial tension.

DE-PS 2 462 391 (Salomon) discloses a still further ski brake of the above-mentioned type wherein the connecting piece is a pressure bar which is resiliently designed and is pivotally supported on the base plate. This connecting piece and an essentially U-shaped braking lever are supported pivotally spaced from one other about a transverse axis fixed relative to the stepping plate on said stepping plate. Upon pivoting the braking lever from the braking position into the skiing position, the U-shaped braking lever is in this conventional ski brake stretched in longitudinal direction over a ski-fixed abutment such that the ends of the braking lever are pressed in their end position in direction of the center of the ski.

A disadvantage of this conventional ski brake is that the pressure bar and its bearing points are subjected to a high material stress and are therefore susceptible to wear. The ski brake furthermore is not loaded with a specific initial tension in its braking position so that it unfortunately does not assume a particularly stable position in this position.

A deficiency of all of the above-mentioned ski brakes is that the spring engages the braking levers through the lever system consisting of a connection piece—stepping plate so that the transfer of the spring force onto these braking levers can indeed be realized with a small number of structural part, however, is kinematically disadvantageous since the resulting force acting onto each braking lever is composed of a component normally to and a component parallel to the braking lever. The force responsible for the pivoting movement of the braking levers is, however, only the normal component so that kinematically caused losses of forces occur in an undesired manner in these conventional ski brakes.

AT-PS 389 819 discloses a ski brake in which the spring-loaded stepping plate is hinged directly to the base plate and not through a connecting piece, and the ends of the braking levers engaging the stepping plate are connected elastically with one another through a spring. The braking levers are each supported on the base plate through a cross bore which is enlarged outwardly in order to reduce the danger of ice formation at this bearing point. Such a ski binding can be realized in an advantageous manner with few structural parts, however, it has among others the disadvantage that the stepping plate cannot assume the desired, essentially horizontal position in the braking position and during the pivoting movement into the skiing position.

SUMMARY OF THE INVENTION

The basic idea of the invention is to improve the action of the spring onto the braking levers compared with conventional ski brakes of the above-mentioned type.

The operating spring engages according to the invention through an extension arm, viewed from the side, spaced from the connecting piece the underside of the stepping plate, with the point of engagement of the extension arm on the stepping plate being variable in longitudinal direction during a pivoting movement of the braking lever.

Thus, the effect of the spring on the stepping plate or rather on the braking levers can be structured independently of the connecting piece and can consequently be adopted to the kinematic requirements. Furthermore, significantly more advantageous lever force ratios are created through this measure with respect to the braking levers so that smaller spring forces are sufficient in order to guarantee a stable position of the braking levers.

The extension arm has in an advantageous manner a slider at its end engaging the stepping plate, which slider is supported on a sliding surface provided on the underside of the stepping plate.

Preferred embodiments of a ski brake of the invention have a sliding surface which is either flat and extends essentially parallel with respect to the upper side of the stepping plate or has an inclined section which transfers rearwardly into a section extending essentially parallel with respect to the stepping plate.

BRIEF DESCRIPTION OF THE DRAWINGS

Further characteristics and advantages of a ski brake embodying the invention result from the following description which description makes reference to the accompanying drawings, in which.

DETAILED DESCRIPTION

Figure 1:
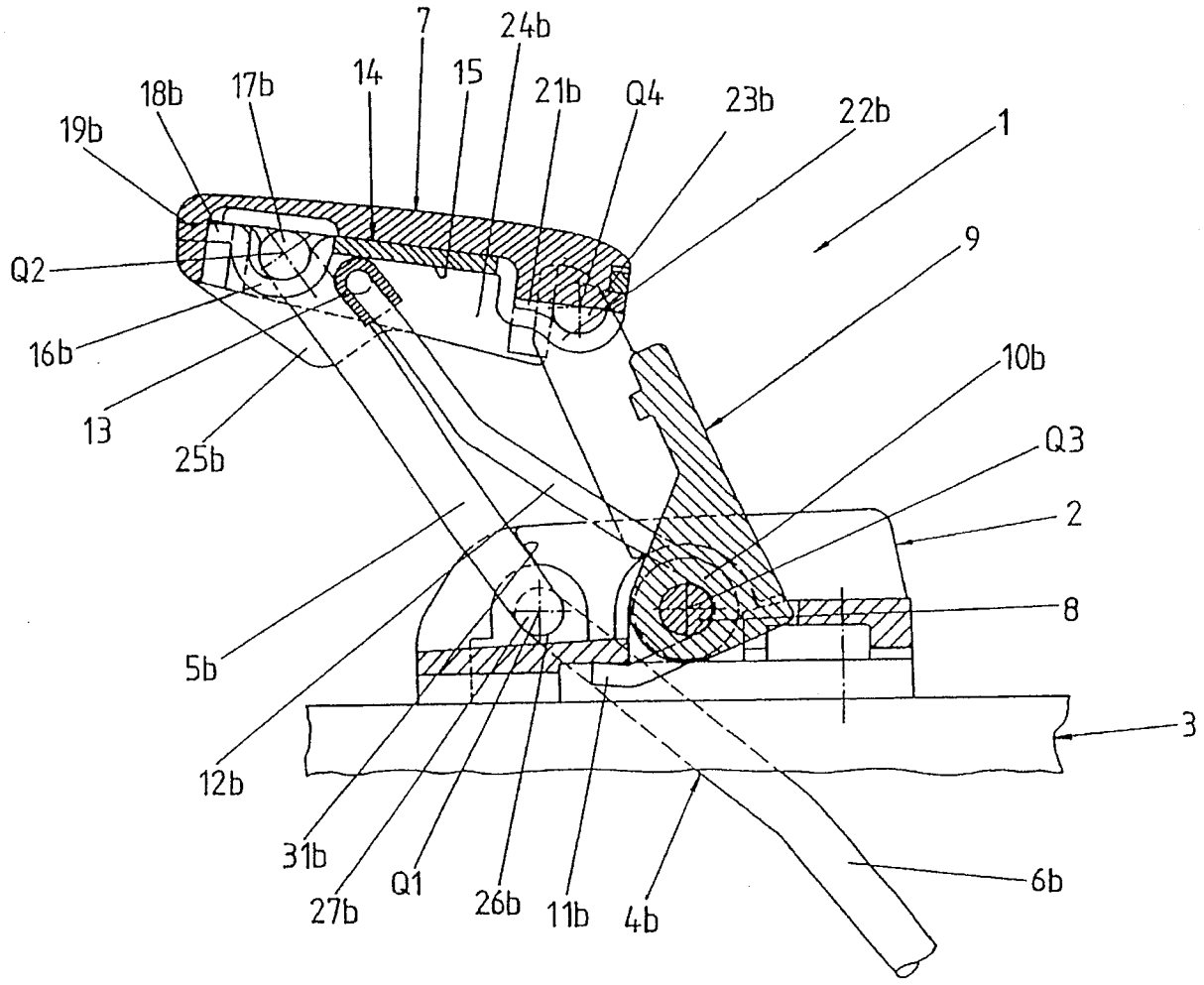
FIG. 1 is a central longitudinal cross-sectional view of one embodiment of a ski brake of the invention in the braking position.

First, reference is made to FIGS. 1 to 6 in which a ski brake 1 of the invention is shown. The ski brake 1 has a base plate 2 which is fastened to a ski 3. Two braking levers 4*a*, 4*b*, which are arranged symmetrically with respect to a central longitudinal plane, are supported pivotally about a transverse axis Q1 and thus each form a two-arm lever with an operating arm 5*a*, 5*b* and a braking arm 6*a*, 6*b*. The operating arms 5*a*, 5*b* of the braking levers 4*a*, 4*b* are supported pivotally about a transverse axis Q2 on a spring-loaded stepping plate 7 arranged essentially horizontally when in the braking position of the ski brake.

A transversely extending cross bolt 8 is furthermore provided on the base plate 2 behind (to the right in FIG. 1) the transverse axis Q1. The cross bolt, in the area of the central longitudinal plane, pivotally supports a connecting piece 9 for movement about a transverse axis Q3 determined by the bolt 8. This connecting piece 9 connects the base plate 2 to the stepping plate 7 and is supported for a limited amount of longitudinal movement on the stepping plate while also being pivotally hinged to the stepping plate 7 about a transverse axis Q4. The swivel axes Q1, Q2, Q3, Q4 form, viewed from the side, essentially a parallelogram, which is a scalene trapezoid or a scalene polygon.

A pair of helical torsion springs 10*a*, 10*b* are provided and arranged symmetrically with respect to the central longitudinal center plane on the cross bolt 8. One leg 11*a*, 11*b* of each torsion spring is fixedly supported on the base plate 2 while the other legs 12*a*, 12*b* extend spaced from the connecting piece 9 to a location on the stepping plate 7. The extension arms or legs 12*a*, 12*b* of the torsion spring 10*a*, 10*b* are, viewed from the side, bent upwardly approximately at their midpoint so that a compact design of the ski brake is possible and a good transfer of the spring force from the base plate onto the stepping plate results. The distal ends of the extension arms 12*a*, 12*b* are bent toward the side and are connected with one another through a slider 13.

The slider 13, preferably made of a low friction, moldable synthetic resin acts on a bearing piece 14 (FIG. 1) or 14' (FIG. 1*a*) arranged on the underside of the stepping plate 7 and has a sliding surface 15 (FIG. 1) or 15' (FIG. 1*a*) for this purpose, which sliding surface extends in a longitudinal direction essentially between the hinge points Q2 and Q4 of the connecting piece 9 to the bearing points of the braking levers 4*a*, 4*b*. The sliding surface 15 illustrated in FIG. 1 and provided on the bearing piece 14 has a flat design and extends essentially parallel to the stepping plate 7, whereas the sliding surface 15' illustrated in FIG. 1*a* and designed on the bearing piece 14' has a section 15'*b* inclined with respect to the stepping plate 7, which section connects two flat sections 15'*a*, 15'*c* extending essentially parallel with respect to the stepping plate 7 with one another. The slider 13 acts through the modified embodiment illustrated in FIG. 1*a* in the braking position on the inclined section 15'*b* of the sliding surface 15', thus additionally reinforcing the component of the spring force, which component acts normally on the braking levers 4*a*, 4*b* and therefore achieving in this position a more stable erect position of the braking levers 4*a*, 4*b*.

The bearing piece 14 or 14' has in the area of the swivel axis Q2 laterally spaced, half shell-like recesses 16*a*, 16*b* which are constructed symmetrically with respect to the central longitudinal plane, and in which are supported the ends 17*a*, 17*b* of the operating arms 5*a*, 5*b* of the braking levers 4*a*, 4*b*, which ends are bent inwardly toward the central longitudinal plane. These half shell-like recesses 16*a*, 16*b* are conically enlarged in direction of the center of the ski so that between the ends 17*a*, 17*b* and these recesses 16*a*, 16*b* there is constructed a free space which enables a lateral pivoting movement of the braking levers 4*a*, 4*b*. The half shell-like recesses 16*a*, 16*b* have furthermore forwardly directed extensions 18*a*, 18*b* which are fitted into corresponding recesses 19*a*, 19*b* provided in the stepping plate. The bearing piece 14 or 14' is fixedly connected, for example riveted, to the stepping plate 7.

The bent ends 17*a*, 17*b* of the operating arms 5*a*, 5*b* are connected with one another in a conventional manner through a spring 20 arranged symmetrically with respect to the central longitudinal plane such that the braking arms 6*a*, 6*b* of the braking levers 4*a*, 4*b* are urged laterally apart. The spring 20 is in the here illustrated embodiments a helical spring which encloses the sections of the ends 17*a*, 17*b*, which sections lie between the half shell-like recesses 16*a*, 16*b*, and is held laterally in position by the half shell-like recesses 16*a*, 16*b*. In the place of this spring 20, it is, however, also possible to use any other resilient element.

Concavely curved lateral guideways 21*a*, 21*b* are provided in the area of the swivel axis Q4, which guideways are arranged on the stepping plate 7 symmetrically with respect to the central longitudinal plane and which are each limited by a rearwardly leading extension 22*a*, 22*b* of the bearing piece 14, 14'. Bolt-shaped projections 23*a*, 23*b* are supported in these curved guideways 21*a*, 21*b*, which projections are provided on and extend laterally of the connecting piece 9 and through which the swivel axis Q4 is determined. The connecting piece 9 is thus supported for a limited amount of longitudinal movement and pivotal movement with respect to the stepping plate 7. The exact operation of this support will be discussed in greater detail later on with reference to the pulling-in operation of the braking levers 4*a*, 4*b*.

The stepping plate 7 (FIGS. 6, 7) has sidewalls 24*a*, 24*b* on both sides thereof which close off the half shell-like recesses 16*a*, 16*b* and the guideways 21*a*, 21*b*. The sidewalls also have downward projections 25*a*, 25*b* formed thereon. The sidewalls 24*a*, 24*b* are provided among others for the lateral support of the operating arms 5*a*, 5*b* directly prior to the pulling in of the braking levers 4*a*, 4*b* (compare FIG. 3), whereas the downward projections 25*a*, 25*b* enable in the skiing position a defined support of the stepping plate 7 on the ski 3 (compare FIG. 4).

The support of the braking levers 4*a*, 4*b* on the base plate 2 is accomplished by means of a bore 26*a*, 26*b* provided transversely with respect to the longitudinal direction along the swivel axis Q1, in which bore is supported a respective one of the braking levers 4*a*, 4*b* in a conventional manner, particularly a respective bearing section 27*a*, 27*b* thereof. Each bearing section 27*a*, 27*b* is bent transversely with respect to the ski and connects the respective operating arm 5*a*, 5*b* to the respective braking arm 6*a*, 6*b*. The swivel axis Q1 of the braking levers 4*a*, 4*b* is determined by these bearing sections 27*a*, 27*b*. The bores 26*a*, 26*b* have both inwardly and outwardly facing conical enlargements 28*a*, 28*b* and 29*a*, 29*b* which permit a certain pivotability of the braking levers 4*a*, 4*b* transversely with respect to the ski. These enlargements 28*a*, 28*b* and 29*a*, 29*b* fulfill in addition the task of preventing the formation of ice at these bearing points through bearing surfaces which are as small as possible.

In the area behind and below each of the outwardly facing conical enlargements 28*a*, 28*b* of the holes 26*a*, 26*b*, the base plate 2 has a laterally outwardly projecting nose 30*a*, 30*b* which is used for the lateral support of the braking levers 4*a*, 4*b* in their braking position and for the lateral guiding of these braking levers 4*a*, 4*b* spaced from the ski 3 during the pivoting movement from the skiing position into the braking position. With this guiding of the braking levers 4*a*, 4*b* over the nose 30*a*, 30*b* during the above-mentioned pivoting movement, it is guaranteed that the braking arms 6*a*, 6*b* of the braking levers 4*a*, 4*b* can be pulled in only when they are above a plane determined by the upper surface of the ski so that any collision of the braking arms 6*a*, 6*b* with the ski 3 is prevented.

In the area of the swivel axis Q1, there is furthermore arranged, viewed from the side, essentially above the bore 26*a*, 26*b* on the base plate 2 a stop 31*a*, 31*b* for limiting the erecting movement of the braking levers 4*a*, 4*b* into their braking position, which stop cooperates with the operating arms 5*a*, 5*b* of the braking levers 4*a*, 4*b*.

Figure 5:
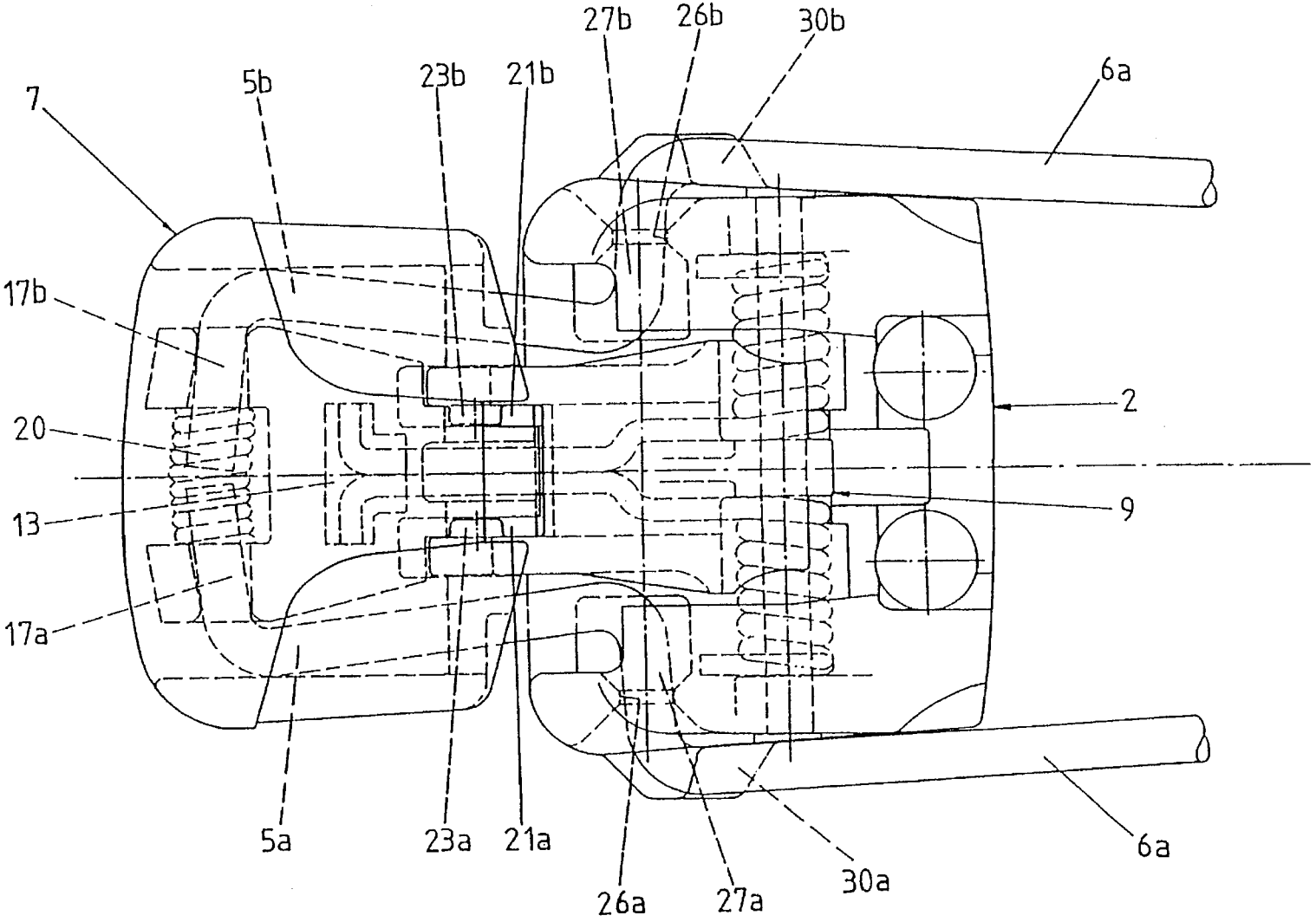
Figure 6:
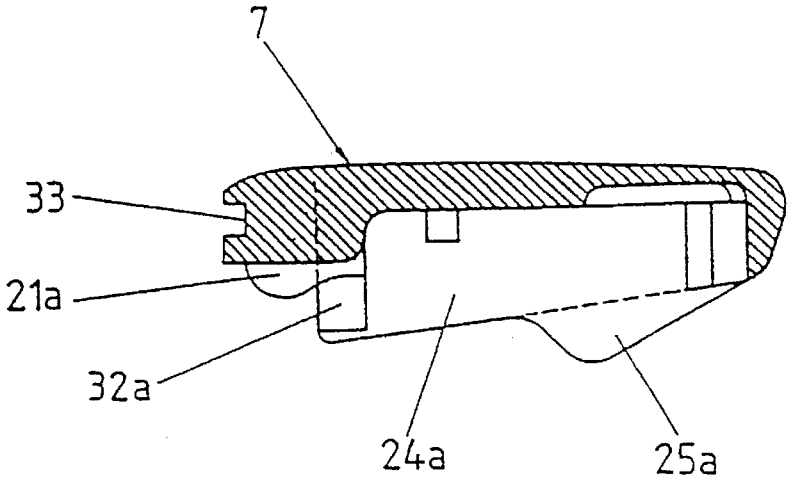
FIGS. 6 and 7 are, respectively, a central longitudinal cross-sectional view of the stepping plate of the ski brake of FIG. 1 or 1*a* (FIG. 6) and rear view thereof (FIG. 7).
Figure 7:
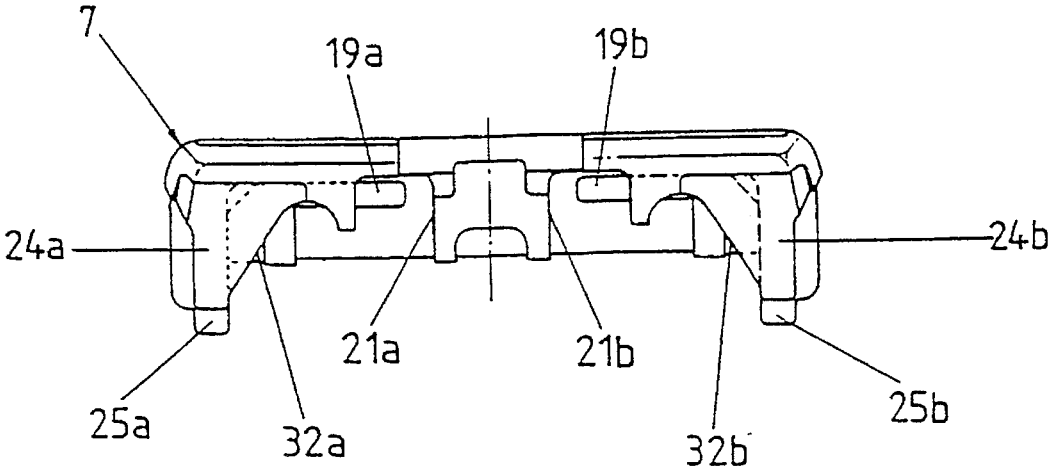

FIGS. 6 and 7 show, respectively, the stepping plate 7 of a ski brake 1 of the invention in a central longitudinal cross-sectional view and a view from the rear. In addition to the already above-discussed characteristics of the stepping plate 7, these figures show two symmetrically arranged guide surfaces 32*a*, 32*b*, which are aligned in longitudinal direction and are inclined with respect to the vertical, and which rise from the sidewalls 24*a*, 24*b* of the stepping plate 7 upwardly inclined in a direction toward the central longitudinal plane. These guide surfaces 32*a*, 32*b* are constructed in the rear part of the stepping plate 7 and cooperate during the transition into the skiing position with the operating arms 5*a*, 5*b* of the braking levers 4*a*, 4*b* so that these are shifted laterally in direction of the center of the ski (compare FIGS. 3 and 5).

A recess 33 is furthermore provided in the rear end section of the stepping plate 7, into which recess the rearwardly leading extensions 22*a*, 22*b* of the bearing piece 14 or 14' are fitted and are connected with one another.

The operation of the ski brake of the invention will be discussed in greater detail hereinafter, in particular the pulling in of the braking levers illustrated in FIGS. 2 to 5.

Figure 1A:
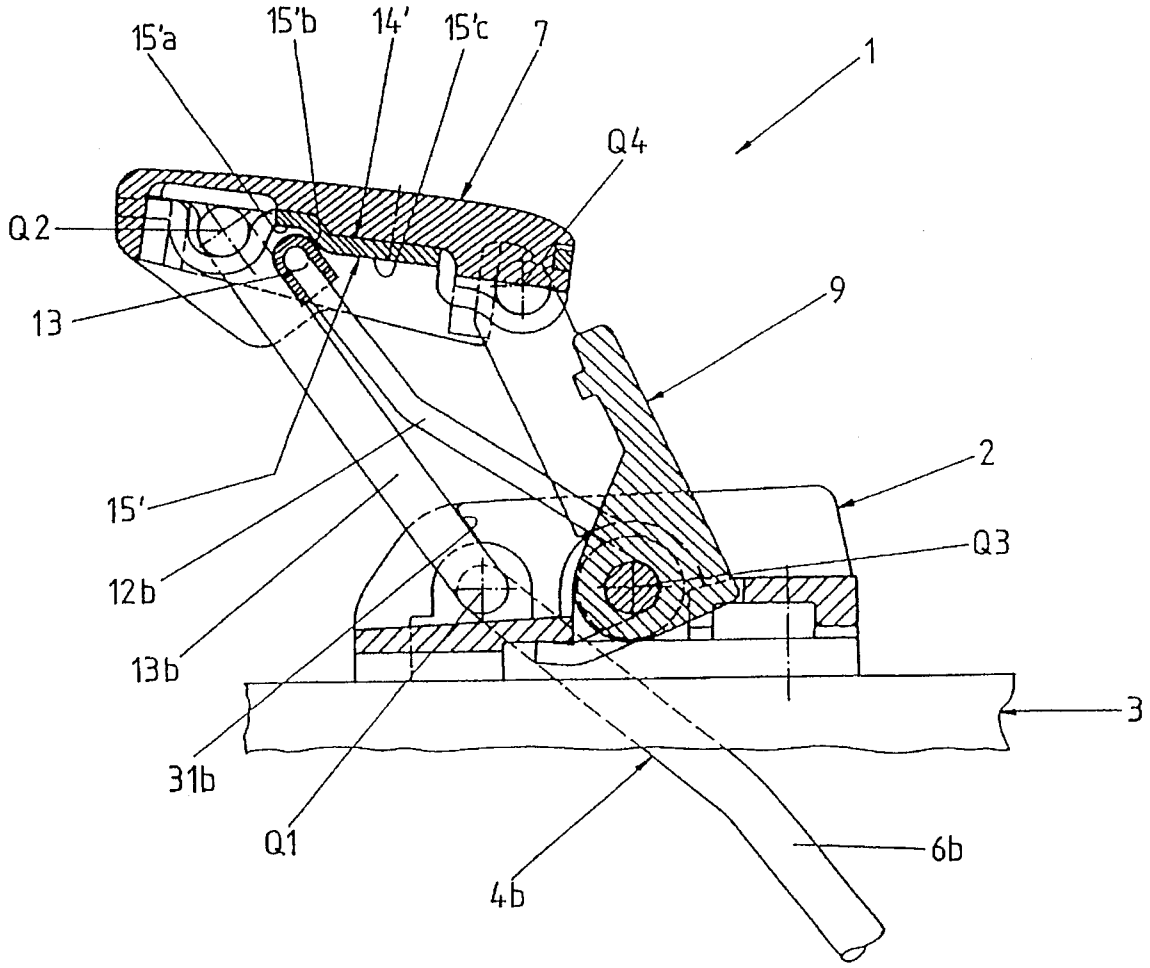
FIG. 1*a* is a central longitudinal cross-sectional view of a further embodiment of a ski brake of the invention in the braking position.

The stepping plate 7 is in the braking position of the ski brake 1 illustrated in FIG. 1 or FIG. 1*a* stressed upwardly by the force of the torsion springs 10*a*, 10*b*, with the slider 13, by means of which the spring force is transferred onto the stepping plate 7, engaging the front left end of the sliding surface 15 or the inclined section 15'*b* of the sliding surface 15'. The operating arms 5*a*, 5*b* of the braking levers 4*a*, 4*b* contact in this position due to the action of the torsion springs 10*a*, 10*b* the stops 31*a*, 31*b* of the base plate 2 so that they assume a stable position in longitudinal direction of the ski. The braking arms 6*a*, 6*b* of the braking levers 4*a*, 4*b* are in this position laterally urged apart by the spring 20 and are laterally supported by the noses 30*a*, 30*b* of the base plate 2 so that also a stable lateral position of the braking levers 4, 4*b* is guaranteed. The bolt-shaped projections 23*a*, 23*b* on the connecting piece 9, which projections are guided in the curved guideway 21*a*, 21*b*, are in their rearmost stop position as can be seen in FIG. 1.

Figure 2:
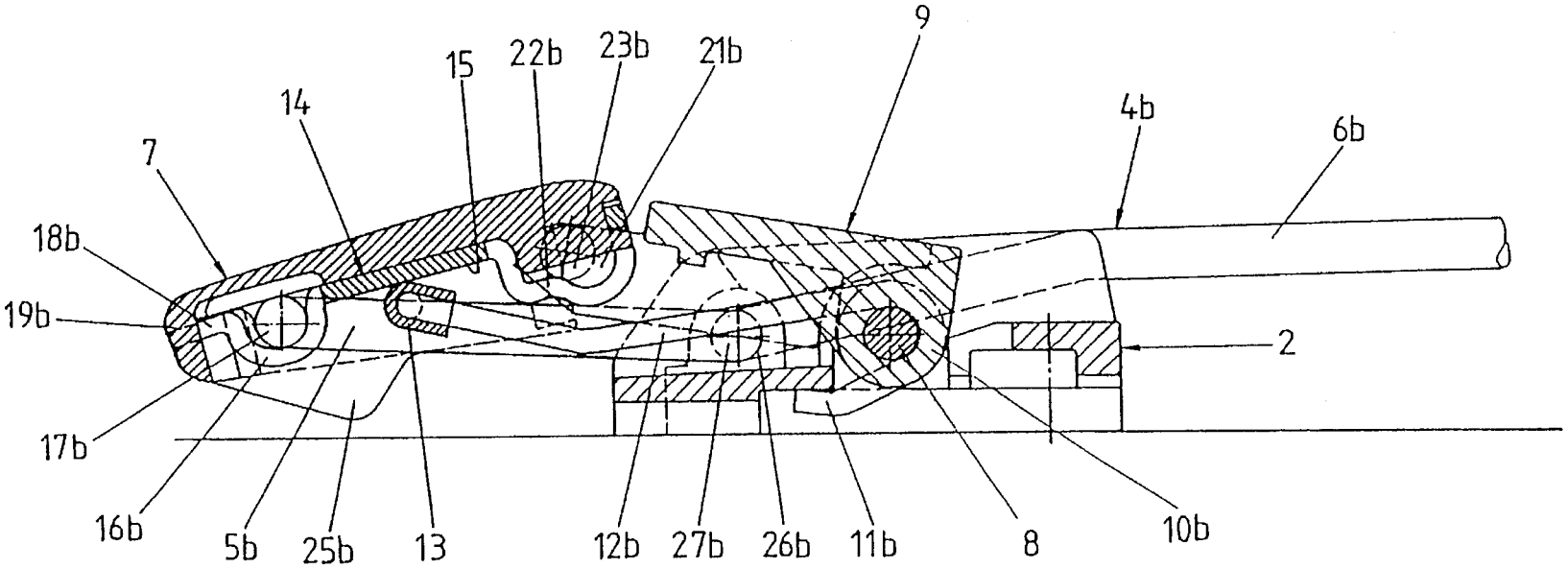
FIGS. 2 and 3 are, respectively, a central longitudinal cross-sectional view and a top view of the ski brake according to FIG. 1 in the swung-down retracted position prior to a pulling in of the braking levers.
Figure 3:
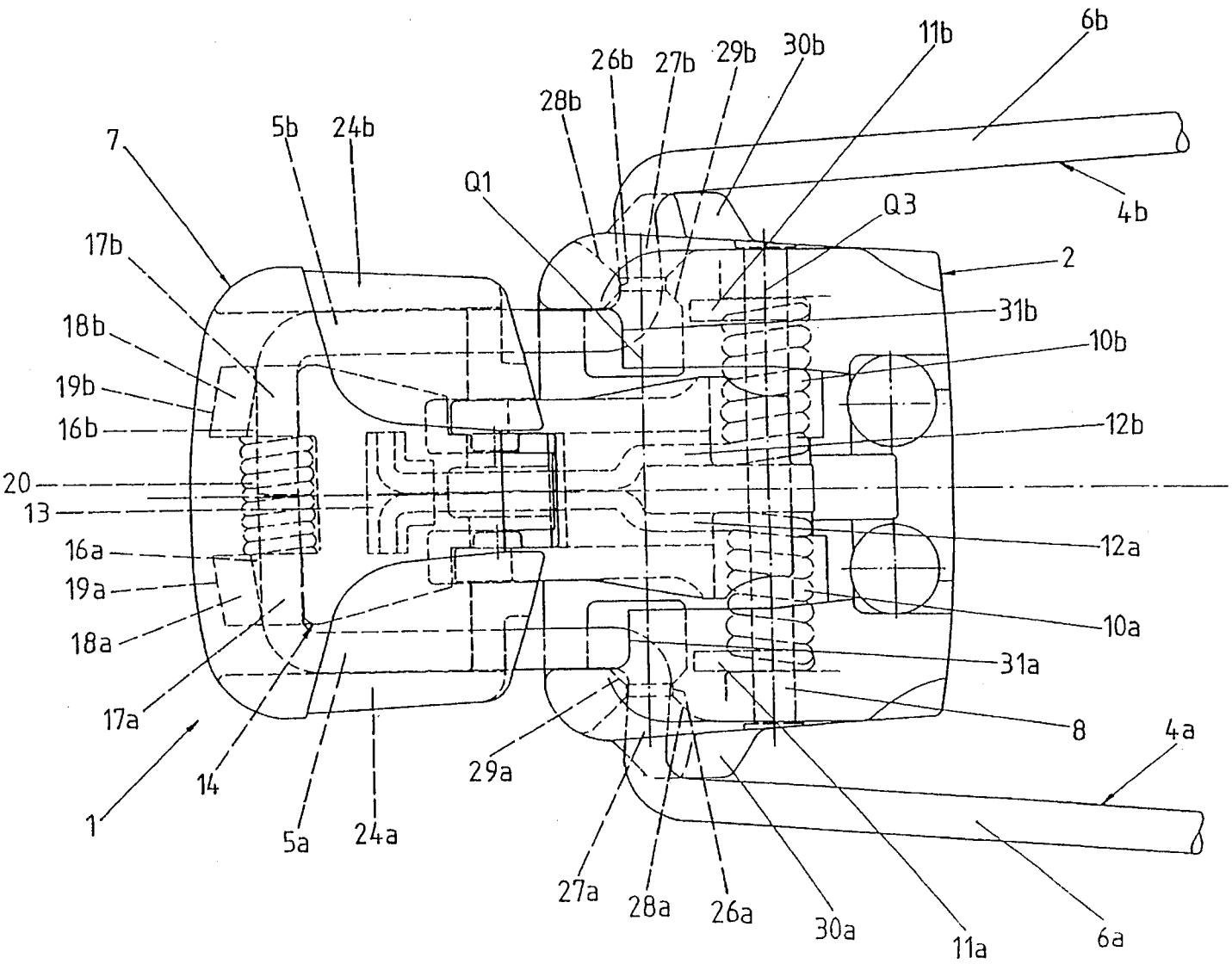

When a ski boot is being inserted into the ski binding, then the ski brake 1 moves first from its braking position into the swung-down retracted position illustrated in FIGS. 2 and 3. The stepping plate 7 is thereby pressed downwardly in direction of the ski 3, with the braking levers 4*a*, 4*b* being pivoted about the axis Q1 and the connecting piece 9 about its bearing sections 27*a*, 27*b* or the axis Q3 in direction of the upper surface of the ski until the position illustrated in FIGS. 2 and 3 has been reached. The slider 13 slides during this pivoting movement from the front end position along the sliding surface 15 or 15' of the bearing piece 14 or 14' rearwardly, thus increasing the return force effect of the torsion springs 10*a*, 10*b* in the rear area of the stepping plate 7. In the modified embodiment of the sliding surface 15' illustrated in FIG. 1*a*, the slider 13 is guided in this phase of the movement from the section 15'*b* inclined with respect to the stepping plate 7 to the rear section 15'*c* of the bearing piece 14', which section extends essentially parallel with respect to the stepping plate 7.

The braking arms 6*a*, 6*b* of the braking levers 4*a*, 4*b* are in the position of the ski brake 1 illustrated in FIGS. 2 and 3 already pivoted sufficiently far upwardly that they are, viewed from the side, above the upper surface of the ski and are aligned essentially parallel with respect to the upper surface. The braking arms 6*a*, 6*b* of the braking levers 4*a*, 4*b*, which are no longer laterally supported by the noses 30*a*, 30b, are in this position urged laterally toward one another by the spring 20 which causes the operating arms 5*a*,5*b* to be supported on the sidewalls 24*a*, 24*b* of the stepping plate 7 so that also in this phase a stable lateral position of the braking levers 4*a*, 4*b* is guaranteed. It can furthermore be seen in FIG. 2 that the bolt-shaped projections 23*a*, 23*b* of the connecting piece 9 are guided slightly forwardly out of their rear stop position along the concavely curved guideways 21*a*, 21*b*. The guide surfaces 32*a*, 32*b* of the stepping plate 7, which can be seen in FIGS. 6 and 7, are in the area of their lower end sections in contact with the operating arms 5*a*, 5*b* without, however, acting thereon in the sense of an application of force in a direction toward the center of the ski. When the stepping plate 7, starting out from the swung-down position shown in FIGS. 2 and 3, is pressed further downwardly in direction of the upper surface of the ski, then the ski brake 1 reaches the skiing position illustrated in FIGS. 4 and 5, in which the braking arms 6*a*, 6*b* of the braking levers 4*a*, 4*b* are with respect to their swung-down position offset laterally in the direction toward the center of the ski. This operation is generally identified as the pulling in of the braking levers and takes place essentially as follows.

Figure 4:
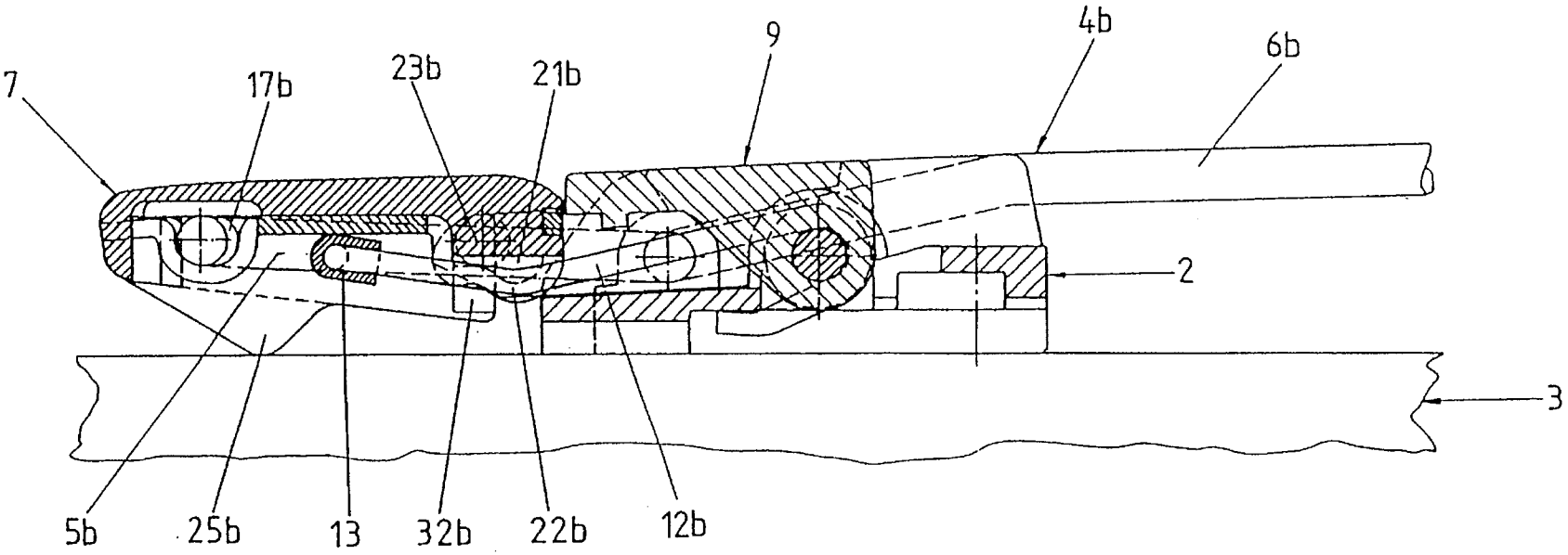
FIGS. 4 and 5 are, respectively, a central longitudinal cross-sectional view and a top view of the ski brake according to FIG. 1 in the fully retracted skiing position.

The stepping plate 7 with its downwardly extending projections 25*a*, 25*b* is urged toward the upper surface of the ski so that the stepping plate 7 and the connecting piece 9 are moved against the return force of the torsion springs 10*a*, 10*b* further downwardly in direction of the ski until the end position, namely, the position whereat the projections 25*a*, 25*b* rest on the upper surface of the ski, illustrated in FIGS. 4 and 5 is reached. The bolt-shaped projections 23*a*, 23*b* of the connecting piece 9 have thereby moved along the guideways 21*a*, 21*b* into their front end position. Through the action of the guide surfaces 32*a*, 32*b* on the operating arms 5*a*, 5*b* of the braking levers 4*a*, 4*b*, the braking arms 6*a*, 6*b* are moved against the force of the spring 20 in direction of the center of the ski. As can be seen in FIG. 5, the bent ends 17*a*, 17*b* of the operating arms 5*a*, 5*b* are inclined to one another in this end position, thus causing the spring 20 to be under tension and urging the braking arms 6*a*, 6*b* apart again immediately after the stepping plate 7 has been relieved from the ski shoe. In order to enable the braking levers 4, 4*b* to have the needed lateral pivoting movement, the half shell-like recesses 16*a*, 16*b* of the bearing piece 14, 14' are provided in direction of the center of the ski with a conically enlarged free space. Also the conical enlargements 28*a*, 28*b* and 29*a*, 29*b* of the bores 26*a*, 26*b* have mainly the task to make possible the freedom of movement needed for the pivoting of the braking levers 4*a*, 4*b*, with the bearing section 27*a*, 27*b* of these braking levers 4*a*, 4*b* being bent such that during the course of the pulling-in operation a friction-free sliding of the bearing sections 27*a*, 27*b* in the associated bores 26*a*, 26*b* is possible.

The ski brake 1 is, when the ski boot steps out of the ski binding, moved again from its skiing position into the braking position, with the above-described operation taking place in reverse sequence.

In conclusion it is remarked that a ski brake embodying the invention can be realized in connection with a number of further embodiments. In particular, the construction of the spring force is not limited to a torsion spring and can be arranged also at other areas in the base plate than those areas disclosed herein.

The embodiments of the invention in which an exclusive property or privilege is claimed are defined as follows:

1. In a ski brake supported for movement between a skiing position and a braking position and having a base plate adapted to be fastened on a ski or a ski binding, at least a pair of braking levers each having a braking arm and an operating arm, said braking levers being arranged on said base plate symmetrically with respect to a central longitudinal plane and are pivotal about an axis extending essentially transversely with respect to the ski, a connecting piece pivotally connected to said base plate and being supported for movement between an upright position corresponding to said braking position and a retracted position corresponding to said skiing position, a stepping plate pivotally connected to said connecting piece on a side of said connecting piece remote from said base plate, and at least one operating spring supported on said base plate and being separate from said braking levers for continually urging said connecting piece, and said stepping plate connected thereto, to said upright position, guide means on said stepping plate, said operating arms of each said braking levers being supported on said guide means, said braking arms being pivotal in the skiing position toward said central longitudinal plane in response to a movement of said stepping plate toward said ski and an operative engagement of said guide means thereon with said operating arms, the improvement wherein means defining a guide path is provided on said stepping plate, wherein said operating spring includes at least one extension arm which extends between said base plate and said guide path on said stepping plate so as to apply a continuous spring force to said stepping plate to cause said continual urging of said connecting piece, and said stepping plate connected thereto, to said upright position, said operating spring slidingly engaging said guide path at a variable point of engagement therealong and in a longitudinal direction during a pivoting movement of said braking levers.

2. The ski brake according to claim 1, wherein said operating spring has at least one two legged torsion spring, one of said two legs being anchored to said base plate and the other of said two legs, which defines said extension arm, having a distal end slidingly engaging said guide path, said distal end having means defining a slider thereon slidingly engaging said guide path on an underside of said stepping plate.

3. The ski brake according to claim 2, wherein a cross bolt is arranged on said base plate, wherein said operating spring includes two helical torsion springs arranged symmetrically with respect to said longitudinal center plane, said torsion springs being supported on said cross bolt, each said torsion spring having a said extension arm arranged symmetrically with respect to said central longitudinal plane, said distal ends of said extension arms being bent transversely with respect to said central longitudinal plane and being connected with one another by said slider.

4. The ski brake according to claim 2, wherein said guide path is flat and extends essentially parallel with respect to an upper side of said stepping plate.

5. The ski brake according to claim 4, wherein said guide path is provided on a bearing piece arranged on said underside of said stepping plate, said bearing piece being made of metal with fastening means being provided for securing said bearing piece to said stepping plate.

6. The ski brake according to claim 5, wherein said bearing piece has symmetrically with respect to said central longitudinal plane two half shell-like recesses in which an end section of each operating arm is received, each said end section being bent in direction of a longitudinal axis of the ski and being connected with one another by an elastic intermediate piece which urges said braking arms of said braking levers laterally outwardly.

7. The ski brake according to claim 2, wherein said guide path has a section inclined at one end which transfers in a rearward direction of the ski into a section extending essentially parallel with respect to an upper side of said stepping plate.

8. The ski brake according to claim 7, wherein said guide path is provided on a bearing piece arranged on said underside of said stepping plate, said bearing piece being made of metal with fastening means being provided for securing said bearing piece to said stepping plate.

9. The ski brake according to claim 8, wherein said bearing piece has symmetrically with respect to said central longitudinal plane two half shell-like recesses in which an end section of each operating arm is received, each said end section being bent in direction of a longitudinal axis of the ski and being connected with one another by an elastic intermediate piece which urges said braking arms of said braking levers laterally outwardly.

10. The ski brake according to claim 1, wherein said guide path is provided on a bearing piece arranged on said underside of said stepping plate, wherein said connecting piece, in addition to said pivotal connection, is supported for longitudinal movement relative to said stepping plate, wherein guideways are provided in lateral wall sections of said stepping plate, said guideways being symmetrical with respect to said central longitudinal plane and are concavely curved with respect to said base plate, and in said guideways bolt-shaped lateral projections of said connecting piece are guided, said guideways being limited in longitudinal length by an extension of said bearing piece extending rearwardly from said stepping plate symmetrically with respect to said central longitudinal plane.

11. The ski brake according to claim 1, wherein each said braking lever has a pivotal bearing section connecting said operating arm and said braking arm and extending generally transversely with respect to said central longitudinal plane, wherein each said pivotal bearing section is supported in a bore in said base plate which also extends transversely with respect to said central longitudinal plane, each said bore having a pair of conical enlargements facing in direction of a longitudinal axis of the ski and also in direction laterally of the ski.

12. The ski brake according to claim 11, wherein said base plate has in an area behind and below each of said bores, a laterally outwardly projecting nose on which said braking arms are supported and guided.

13. The ski brake according to claim 1, wherein said stepping plate has on an underside thereof inclined surfaces operatively engaging said operating arms of said braking levers, said inclined surfaces being aligned generally in longitudinal direction of the ski and extend upwardly inclined in direction of said central longitudinal plane, said braking levers being urged to said skiing position and in direction of said central longitudinal plane by said inclined surfaces.

14. The ski brake according to claim 3, wherein said slider is made of plastic.

* * * * *